United States Patent [19]

D'Andrade et al.

[11] Patent Number: 5,074,437

[45] Date of Patent: Dec. 24, 1991

[54] PINCH TRIGGER PUMP WATER GUN

[76] Inventors: Bruce M. D'Andrade, 3 Ten Eyck Rd., Whitehouse Station, N.J. 08889; Lonnie G. Johnson, 2923 N. Casitas Ave., Altadena, Calif. 91001

[21] Appl. No.: 578,145

[22] Filed: Sep. 6, 1990

[51] Int. Cl.[5] ..... A63H 3/18

[52] U.S. Cl. ..... 222/79; 222/400.8; 222/401; 42/54; 273/349; 446/473

[58] Field of Search ..... 222/79, 400.7, 400.8, 222/401, 325, 396; 273/349; 124/70, 73; 42/54; 446/473

[56] References Cited

U.S. PATENT DOCUMENTS

| | | | |
|---|---|---|---|
| 2,049,194 | 7/1936 | Chapin et al. | 222/400.8 X |
| 2,589,977 | 3/1952 | Stelzer | 222/401 X |
| 3,005,495 | 10/1961 | Herberg | 222/79 X |
| 3,197,070 | 7/1965 | Pearl et al. | 222/79 |
| 3,938,709 | 2/1976 | Collar | 222/325 X |
| 4,214,674 | 7/1980 | Jones et al. | 222/79 |
| 4,441,629 | 4/1984 | Mackal | 222/396 X |
| 4,591,071 | 5/1986 | Johnson | 222/401 X |
| 4,735,239 | 4/1988 | Salmon et al. | 446/473 X |
| 4,743,030 | 5/1988 | Auer et al. | 222/79 X |
| 4,757,946 | 7/1988 | Johnson | 239/99 |
| 4,854,480 | 8/1989 | Shindo | 446/473 X |

FOREIGN PATENT DOCUMENTS

| | | | |
|---|---|---|---|
| 431955 | 7/1935 | United Kingdom | 222/79 |
| 669983 | 4/1952 | United Kingdom | 222/79 |

*Primary Examiner*—Michael S. Huppert
*Assistant Examiner*—Gregory L. Huson
*Attorney, Agent, or Firm*—Kenneth P. Glynn

[57] ABSTRACT

The present invention is directed toward a toy water gun which is operated by selectively releasing water from a water reservoir that is pressurized with air. The present invention is a one piece device formed in the general shape of a gun that has a manually operated air pump incorporated into the design. The air pump pressurized a water reservoir and consequently pressurizes any water found therein. The pressurized water has an avenue of release that is regulated by the trigger mechanism of the invention. When no force is applied to the trigger, the pressurized water is held at bay with no means of release. When force is applied to the trigger, water is released from the pressurized container and is channeled through a narrow nozzle. The escape of the pressurized water through the narrow nozzle creates a stream of propelled water that lasts as long as the trigger is engaged or until the pressure of the water equals the ambient air.

18 Claims, 2 Drawing Sheets

PINCH TRIGGER PUMP WATER GUN

BACKGROUND OF THE INVENTION

1. Field of the Invention

The present invention is directed toward a pressurized toy water gun, and more particularly to such toy water guns that use self-contained means of pressurizing a water reservoir with air, creating a pressure differential between the contained water and the ambient atmosphere that propels water from the toy either in a continuous stream or in a selective manner.

2. Prior Art Statement

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Such pump action water guns work, but the guns are limited in the distance the water traveled, the amount of water projected and the duration of the pumping cycle. In an attempt to improve upon water guns, the toy industry has developed pressure activated water guns. Such pressure water guns work upon the principle of pressure differentials between the water held within the toy and the atmosphere. The water within the toy is held at a pressure higher than that of the ambient air. As a result, when the water within the toy is given an avenue of escape, the water will stream out under pressure.

Two primary types of pressure activated water toys exist. The first type is when the water itself is worked to a pressure higher than that of the ambient air. This type of water gun is exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured area. Once the confined area is fully collapsed, the re-expansion of the area draws forth more water from a reservoir, thus priming the water gun for another cycle.

U.S. Pat. Nos. 4,854,480 to Robert S. Shindo and 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clapping device activated by a trigger. The water gun is used by selectively releasing the water from the expanded bladder.

The second type of pressure activated water toys are toys that use air pressure to force water through squirt channels. Such toys that use this technology are exemplified by U.S. Pat. No. 4,214,674 to Jones et al. The Jones patent shows a two piece apparatus consisting of a pressurized water reservoir and a discharging gun. The Jones patent has a hand operated air pump but differs from the present invention in that it does not have a one piece self contained pressurization system and lacks the valve configuration needed to support such a self contained system. Additionally, the present invention has the capability of working at very high pressures and incorporates safety criteria into its design to eliminate the inherent dangers of high pressure liquids.

Thus, prior art does teach us of toy water guns that operate by the pressurization of stored water but, prior art does not teach or suggest a toy water gun that has a self-contained means of pressurizing stored water with air, and has a valve configuration that allows pressurized air and water to enter and exit the stored water reservoir through and by the same opening. Thus, allowing the present invention water gun to be a one piece unit and to have a high pressurization capacity results in ease of both use and manufacturability. Also, prior art fails to teach or suggest the use of highly pressurized air with water toys and fails to recognize the needed design criteria and safety allowances to eliminate the traditional hazards of producing, storing and discharging high pressure liquids.

SUMMARY OF THE INVENTION

The present invention is directed toward a toy water gun which is operated by selectively releasing water from a water reservoir that is pressurized with air. The present invention is a one piece device formed in the general shape of a gun that has a manually operated air pump incorporated into the design. The air pump pressurizes a water reservoir and consequently pressurizes any water found therein. The pressurized water has an avenue of release that is regulated by the trigger mechanism of the invention. When no force is applied to the trigger, the pressurized water is held at bay with no means of release. When force is applied to the trigger, water is released from the pressurized container and is channeled through a narrow nozzle. The escape of the pressurized water through the narrow nozzle creates a stream of propelled water that lasts as long as the trigger is engaged or until the pressure of the water equals the ambient air. Water is added to the present invention by removing the water reservoir from the gun, filling the reservoir and reattaching the reservoir. Upon reattachment, the orifice through which the water reservoir was filled serves as both the entrance point of pressurized air from the air pump, and the exit point of the pressurized water. This single orifice water reservoir design holds the integrity of the reservoir's walls intact, allowing the water reservoir to hold high pressures without fear of rupture. Additionally, the danger of rupture is eliminated by a triggering device that automatically and safely discharges pressurized water when over pressurized, until the maximum allowable pressure is reached.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 3:
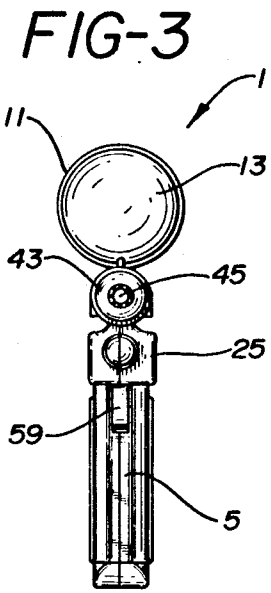
FIG. 3 shows the front view of the preferred embodiment expressed by FIGS. 1 and 2.

The present invention is, as mentioned, directed toward a toy water gun that uses air to pressurize water and propel the water through a narrow nozzle. Pressurized water toys are not new; they have been in existence for decades. Water pressure has been used in the toy industry for everything from launching toy rockets to propelling toy cars. Pressurized water toys come in two primary types. First are water toys that use mechanical means to directly compress and pressurize water. Such toys represent a majority of the water toys manufactured today, and are exemplified by traditional water guns that use a trigger operated pump or a battery powered motor to squirt small amounts of water. The problem with toys that directly pump water is that to get the required pressure for a satisfactory squirt, a small diameter piston is required. This in turn limits the amount of water that can be squirted in each shot. In addition, the speed at which the pump is activated, whether manually or by motor, affects the distance of the shot, and it requires many cycles to project any significant amount of water.

To solve these, toy manufacturers have turned to the technology of compressed air to pressurize a reservoir of water. Air is easily compressed to high pressures and this high pressure can be transferred to stored water. This technology is easily adapted to a child's strength and allows a relatively large amount of water to be pressurized at one time. This large reserve of pressurized water allows a water gun to fire a large continuous stream of water at one time without the need for repeated pumping cycles.

The problem with air pressurized toys is one of safety. Toys are designed to be inexpensive so as to be widely marketable. As such, most toys are made of plastics or other inexpensive materials. Such materials do not have large tensile strengths or fatigue characteristics, and therefore do not lend themselves well to containing pressurized fluids. Plastic containments of pressurized liquids, if not properly designed, can rupture and explode causing severe injury. The present invention has a unique design that allows for both the use of high pressure air and the elimination of potential rupturing hazards. The present invention has a cylindrical water reservoir with a single opening. The single orifice, in conjunction with the generous radii used at the cylinder ends, serve to maintain the integrity of the water reservoir walls and minimize the leak points throughout the material of the water reservoir, thereby allowing for the safe use of pressures almost twice as great as those in any other configuration. To use a single orifice water reservoir design, the present invention was designed so that both the pressurized air from the air pump and the exiting pressurized water utilize the same opening without back flow problems to either. Additionally, since the water reservoir must be periodically refilled with water, and since the water reservoir has only one opening, the water reservoir is designed to detach from the air pump inlet and the pressurized water outlet so that ambient pressure water can be added.

The present invention water gun is operated by selectively releasing the pressurized water through a narrow nozzle. The selective release of the pressurized water is controlled by the trigger mechanism of the water gun. Since the present invention has the ability to operate at high pressures, the trigger release mechanism performs two functions. First it controls the amount of water released and, second, the trigger mechanism serves as a safety valve. The trigger of the present invention has an extension that pinches the exit hosing of the pressurized water. The pinching force is created by a spring. When the trigger is pressed, the spring bias of the pinching member is overcome and water is released. Similarly, when the pressure in the water reservoir reaches beyond safety limitations, the force of the compressed water will overcome the spring bias of the pinching member allowing water to be released until the pressure within the reservoir reaches a safe level.

Figure 1:
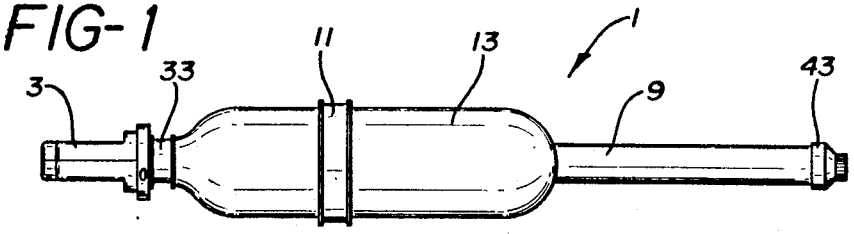
FIG. 1 shows the top view of one preferred embodiment of the present invention.
Figure 2:
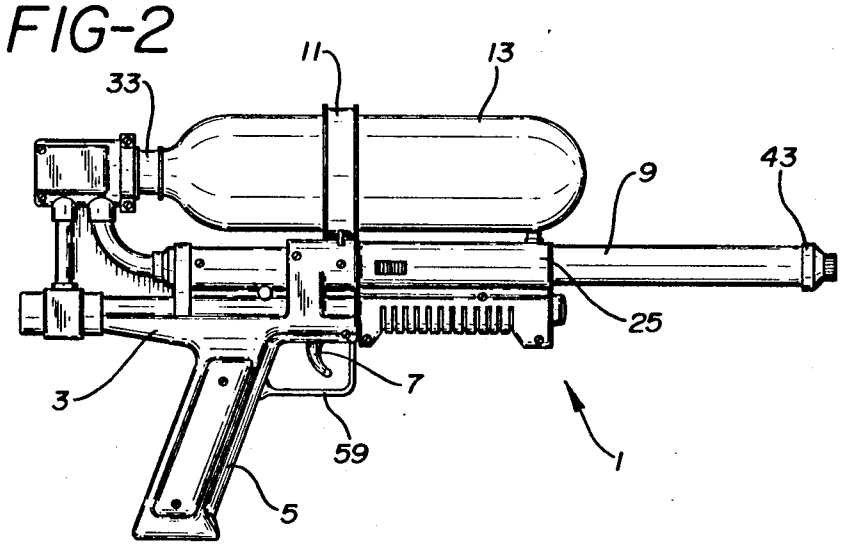
FIG. 2 shows the side view of the preferred embodiment expressed in FIG. 1.

Referring now to FIGS. 1, 2 and 3 there are shown the respective top, side and front views of one preferred embodiment of the present invention 1 with like parts being like numbered. Shown from these Figures is the general gun like shape of the embodiment 1, having a main housing 3 with extending barrel 9, trigger 7, and handle 5. The detachable water reservoir 13 is held to the main housing 3 via an attachment collar 11 and reservoir mount 33. The air pump of the present invention is embodied within the main housing 3 but the handle to the pump is attached to the slider handle 25 that travels along, and is guided by the water gun barrel 9.

Figure 4:
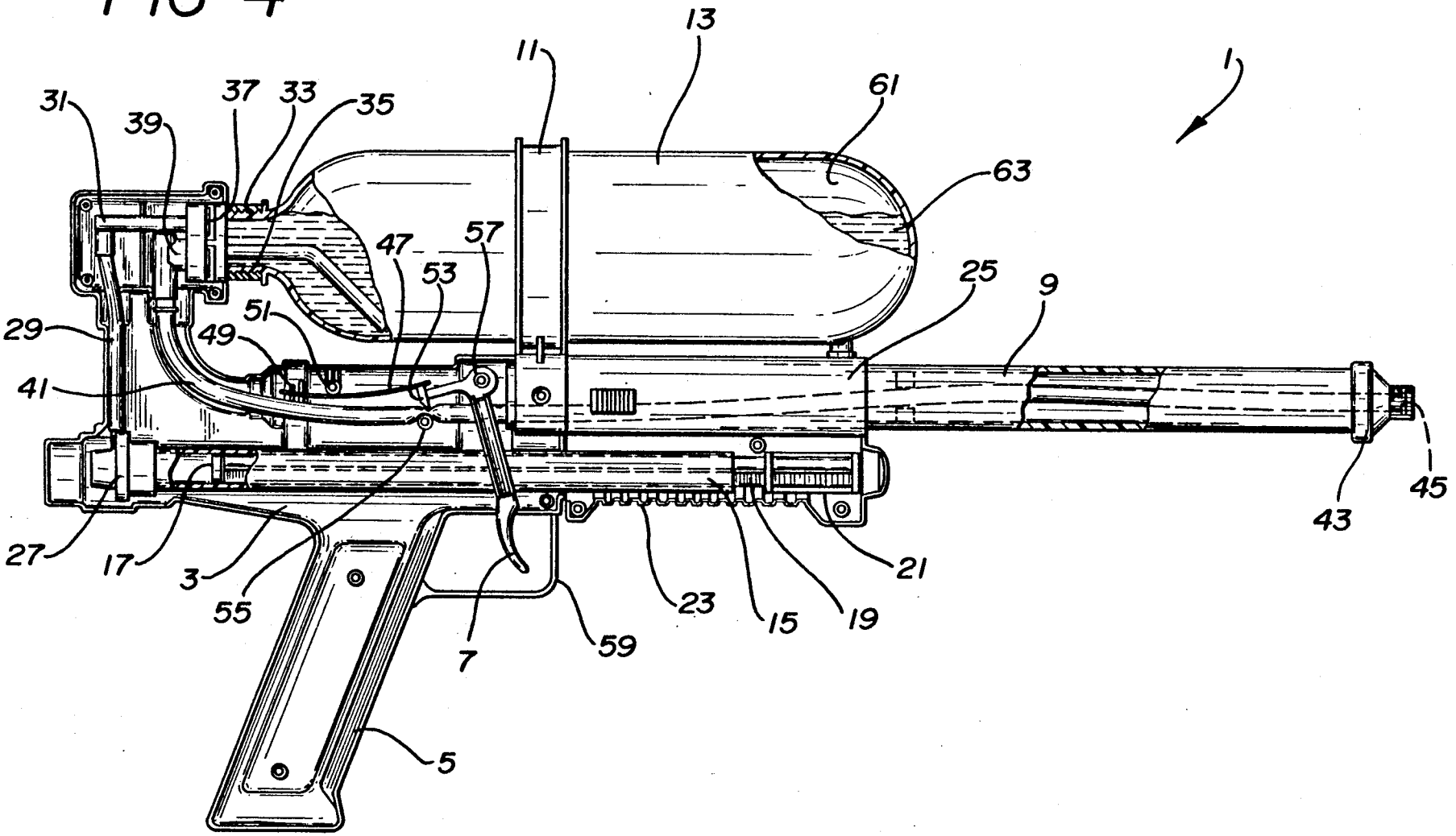
FIG. 4 shows a selective side view of one preferred embodiment of the present invention with sections removed to better show interior mechanisms.

Referring now to FIG. 4, the operation of the present invention embodiment can best be explained. FIG. 4 is a side view of the present invention embodiment with selective portions of the main housing 3, water reservoir 13 and barrel 9 removed. The water reservoir 13 is cylindrical and has a threaded orifice 35. To fill the water reservoir 13 with water 63, the water reservoir must be detached from the main housing 3 by unscrewing the threaded orifice 33 from the sympathetically threaded reservoir mount 33, water 63 is then placed into the reservoir 13 and the water reservoir 13 is rethreaded into position. Once filled with water 63, the water gun 1 is operated by pressurizing the water reservoir 13 with air 61. Air 61 is forced into the reservoir by the relative movement of the piston 17 within the air pump shaft 15. The piston 17 is operated by the pump rod 19 that connects the piston 17 to the slider handle 25. The pump rod 19 is anchored to the slider handle 25 via a formed connector 21. The slider handle 25 is operated manually by the user of the water gun 1. A user holds the slider handle 25 with one hand and the gun handle 5 with the other. The slider handle 25 is then moved back and forth along the length of the barrel 9. The back and forth action is transferred to the piston 17, which forces air 61 past a one way flow valve 27, through a length of air flow tubing 29, through a water backflow prevention flap 37 and into the water reservoir 13. Air 61 is continuously added to the water reservoir 13 until a desired pressure is reached.

Once under pressure, the water 63 is prevented from flowing freely through the outlet tubing 41 by a pinch bar 53 that clamps the outlet tubing 41 against a stop 55 that is part of the main housing 3. The pinch bar 53 is biased against the stop 55 by a calibrated spring 47. The spring is held at one end by a formation 49 of the main housing 3 and is stressed by being deformed over a pivot 51. The strength of the spring 47 in its biased configuration is calibrated, so that when the pressure of water 63 within the outlet tubing 41 reaches a predetermined maximum valve, the spring 47 will allow the pinch bar 53 to rise and water 63 will be released until safe pressure is maintained.

Absent an automatic water release for an overly high pressure, water 63 is released in the following manner. Force is applied to the trigger 7, and is transferred to the pinch bar 53 via the levered configuration of the trigger 7 that rotates around pivot 57. The transferred force applied to the pinch bar 53 acts in opposition to the biasing force of spring 47. When the force of the trigger 7 overcomes the force of the spring 47 the pinch bar 53 is lifted from the outlet tubing 41 and water 63 is allowed to pass through the outlet tubing 41 within the barrel 9. The barrel outlet tubing 41 terminates at a nozzle 43 that has a narrow opening 45. Water 63 streams out of the narrow opening 45 until either the force on the trigger 7 is released or until the air pressure stored within the water reservoir 13 reaches ambient.

It is therefore understood that although the invention described within the above specification shows the best known mode of the present invention, the invention may be formed, shaped, practiced, or made of differing materials than is specifically described within.

What is claimed is:

1. A high pressure, self-contained, air pressured toy water gun, which comprises:

(a) a housing;

(b) an extended handle connected to said housing;

(c) a trigger located on said housing adjacent said handle;

(d) a barrel portion of said housing extending outwardly away from said handle;

(e) a high pressure, detachable water storage reservoir having only a single orifice;

(f) an attachment means located on said water gun housing for attaching said water storage reservoir to said water gun housing by attachment of said single orifice to said attachment means, and, when said water storage reservoir single orifice is attached thereto, forming therewith a seal impervious to water;

(g) a pressuring means with a slider, for pressurizing said water storage reservoir with air, said means being an integral part of said water gun housing;

(h) an elongated avenue of release for water displaced by said pressurized air, said avenue of release depending from said attachment means and running the length of said barrel;

(i) a water release means for regulating the fluid flow through said avenue of release, said water release means being attached to said trigger of said water gun and functionally connected to said avenue of release, and regulated by the movement of said trigger; and, (j) a nozzle at the end of said barrel, said nozzle being connected to said avenue of release;

wherein said attachment means and water storage reservoir are remotely located on said housing away from said pressuring means slider.

2. The invention of claim 1 wherein said water storage reservoir is designed to hold at least 100 pounds per square inch of pressure.

3. The invention of claim 1 wherein the flow of air from said water storage reservoir to said means of pressurization is prevented by a one way flow device.

4. The invention of claim 1 wherein the flow of water from said water storage reservoir into said means of pressurization is prevented by a one way flow device.

5. The invention of claim 1 wherein said water storage reservoir has a threaded neck surrounding said orifice that attaches to said water gun housing via a sympathetically threaded housing mount.

6. The invention of claim 1 wherein said nozzle has a narrow orifice therethrough with a cross-sectional area less than that of said avenue of release.

7. The invention of claim 1 wherein said water reservoir holds at least one half liter of liquid.

8. The invention of claim 1 wherein said attachment means has a elongated hollow member depending therefrom, said elongated hollow member extending through said orifice of said water storage reservoir and terminating at the lowest point within said reservoir.

9. The invention of claim 1 wherein said means for pressurizing said water storage reservoir is a hand operated air pump.

10. The invention of claim 9 wherein said air pump has a pumping stroke action along an axis parallel to said barrel.

11. The invention of claim 10 wherein said hand pump has a handle guided by said extended barrel.

12. The invention of claim 1 wherein said avenue of release is a flexible tube connecting said attachment means with said nozzle.

13. The invention of claim 12 wherein said means of regulatory fluid flow is a spring biased pinch bar that clamps said avenue of release against said water gun housing, collapsing said avenue of release thus restricting the fluid flow therethrough.

14. The invention of claim 13 wherein said spring bias is calibrated to yield to pressure within said avenue of release, when said pressure within said avenue of release exceeds a predetermined maximum value.

15. The invention of claim 14 wherein said maximum value for the yeilding of said spring bias to said pressure within said avenue of release is between 50 pounds per square inch and 90 pounds per square inch.

16. The invention of claim 13 wherein said spring bias of said pinch bar is overcome by a force applied to said trigger, whereby said pinch bar is formed as part of said trigger and said force applied to said trigger, through a lever action, causes said pinch bar to move in opposition of said spring bias.

17. The invention of claim 16 wherein said spring bias is formed by a straight spring having two ends, one end being anchored to said water gun housing and said second end engaging said pinch bar.

18. The invention of claim 17 wherein said attachment means has a elongated hollow member depending therefrom, said elongated hollow member extending through said orifice of said water storage reservoir and terminating at the lowest point within said reservoir.

* * * * *

US005074437B1

REEXAMINATION CERTIFICATE (3397th)

United States Patent [19] [11] B1 5,074,437

D'Andrade et al. [45] Certificate Issued Dec. 16, 1997

[54] PINCH TRIGGER PUMP WATER GUN

[75] Inventors: Bruce M. D'Andrade, Whitehouse Station, N.J.; Lonnie G. Johnson, Altadena, Calif.

[73] Assignee: Larami Limited, Mt. Laurel, N.J.

Reexamination Request:
No. 90/004,551, Feb. 14, 1997

Reexamination Certificate for:

| | |
|---|---|
| Patent No.: | **5,074,437** |
| Issued: | **Dec. 24, 1991** |
| Appl. No.: | **578,145** |
| Filed: | **Sep. 6, 1990** |

[51] Int. Cl.[6] ..... A63H 3/18

[52] U.S. Cl. ..... 222/79; 222/400.8; 222/401; 42/54; 273/349; 446/473

[56] References Cited

U.S. PATENT DOCUMENTS

| | | | |
|---|---|---|---|
| D. 78,206 | 4/1929 | Hermann . | |
| D. 191,686 | 10/1961 | Johnson et al. . | |
| 2,017,145 | 10/1935 | Dunn . | |
| 4,239,129 | 12/1980 | Esposito | 222/79 |
| 4,606,477 | 8/1986 | Spengler et al. | 222/153 |
| 4,700,872 | 10/1987 | Keyes et al. | 222/162 |

*Primary Examiner*—Gregory L. Huson

[57] ABSTRACT

The present invention is directed toward a toy water gun which is operated by selectively releasing water from a water reservoir that is pressurized with air. The present invention is a one piece device formed in the general shape of a gun that has a manually operated air pump incorporated into the design. The air pump pressurized a water reservoir and consequently pressurizes any water found therein. The pressurized water has an avenue of release that is regulated by the trigger mechanism of the invention. When no force is applied to the trigger, the pressurized water is held at bay with no means of release. When force is applied to the trigger, water is released from the pressurized container and is channeled through a narrow nozzle. The escape of the pressurized water through the narrow nozzle creates a stream of propelled water that lasts as long as the trigger is engaged or until the pressure of the water equals the ambient air.

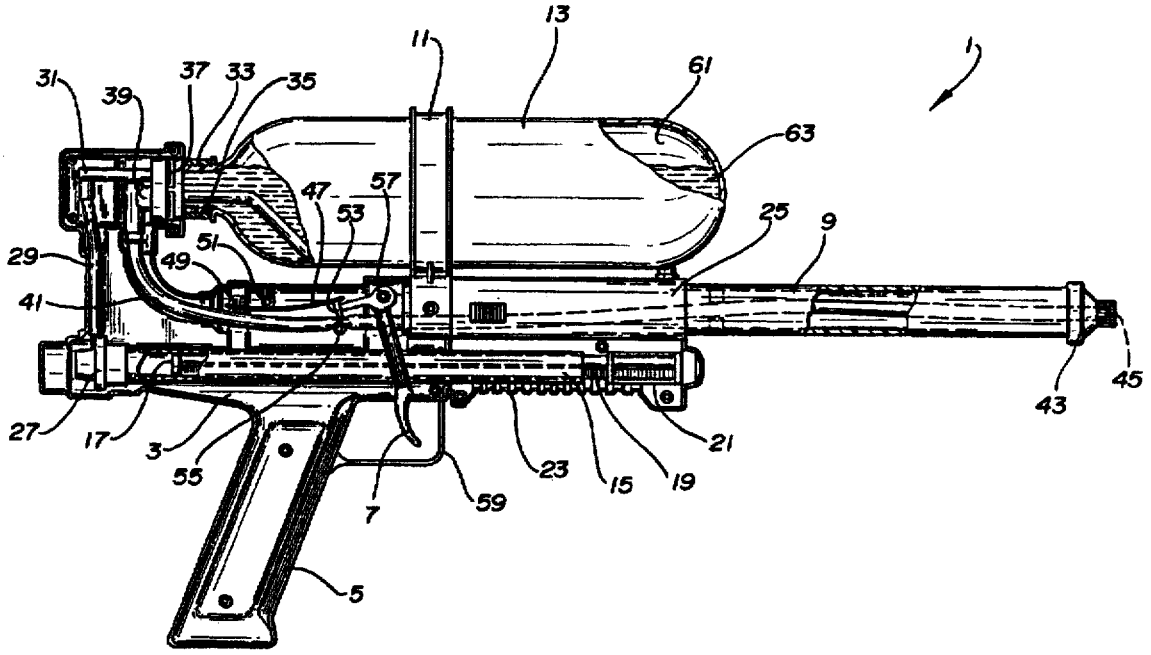

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *